US007261087B2

(12) United States Patent
Ricco et al.

(10) Patent No.: US 7,261,087 B2
(45) Date of Patent: Aug. 28, 2007

(54) HIGH-PRESSURE VARIABLE-FLOW-RATE PUMP FOR A FUEL-INJECTION SYSTEM

(75) Inventors: Mario Ricco, Valenzano (IT); Sisto Luigi De Matthaeis, Valenzano (IT); Annunziata Anna Satriano, Vaelnzano (IT); Onofrio De Michele, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 178 days.

(21) Appl. No.: 11/095,425

(22) Filed: Mar. 31, 2005

(65) Prior Publication Data

US 2006/0000447 A1 Jan. 5, 2006

(30) Foreign Application Priority Data

Jun. 30, 2004 (EP) ..... 04425480

(51) Int. Cl.
*F02M 33/04* (2006.01)

(52) U.S. Cl. ..... 123/446; 123/456

(58) Field of Classification Search ..... 123/446, 123/447, 506, 467

See application file for complete search history.

(56) References Cited

U.S. PATENT DOCUMENTS 4,501,246 A * 2/1985 Leblanc ..... 123/449
4,884,545 A * 12/1989 Mathis ..... 123/447
4,957,084 A * 9/1990 Kramer et al. ..... 123/447
5,619,970 A * 4/1997 Collingborn ..... 123/447
6,234,148 B1 * 5/2001 Hartke et al. ..... 123/447
6,253,734 B1 * 7/2001 Rembold et al. ..... 123/446
6,311,674 B1 * 11/2001 Igashira et al. ..... 123/458
6,439,199 B2 * 8/2002 Ramseyer et al. ..... 123/446
6,497,216 B2 * 12/2002 Gaessler et al. ..... 123/450
6,739,317 B2 * 5/2004 Kellner et al. ..... 123/446
6,823,845 B2 * 11/2004 Schueler ..... 123/446
6,889,656 B1 * 5/2005 Rembold et al. ..... 123/446

FOREIGN PATENT DOCUMENTS

DE 197 14 489 C 10/1998
DE 103 45 154 A 4/2004
EP 0 270 720 A 6/1988
EP 0 299 337 A 1/1989

* cited by examiner

*Primary Examiner*—Thomas Moulis
(74) *Attorney, Agent, or Firm*—Ladas and Parry LLP

(57) ABSTRACT

The high-pressure pump (7) comprises a number of pumping elements (18) actuated in reciprocating motion through corresponding suction and delivery strokes. Each pumping element (18) is provided with a corresponding intake valve (25), in communication with an intake pipe (10), supplied by a low-pressure pump (9). Arranged on the intake pipe (10) is a shut-off valve (27) controlled in a choppered way in synchronism with an initial part (32; 32') of the suction stroke of each pumping element (18).

5 Claims, 2 Drawing Sheets

HIGH-PRESSURE VARIABLE-FLOW-RATE PUMP FOR A FUEL-INJECTION SYSTEM

Figure 1:
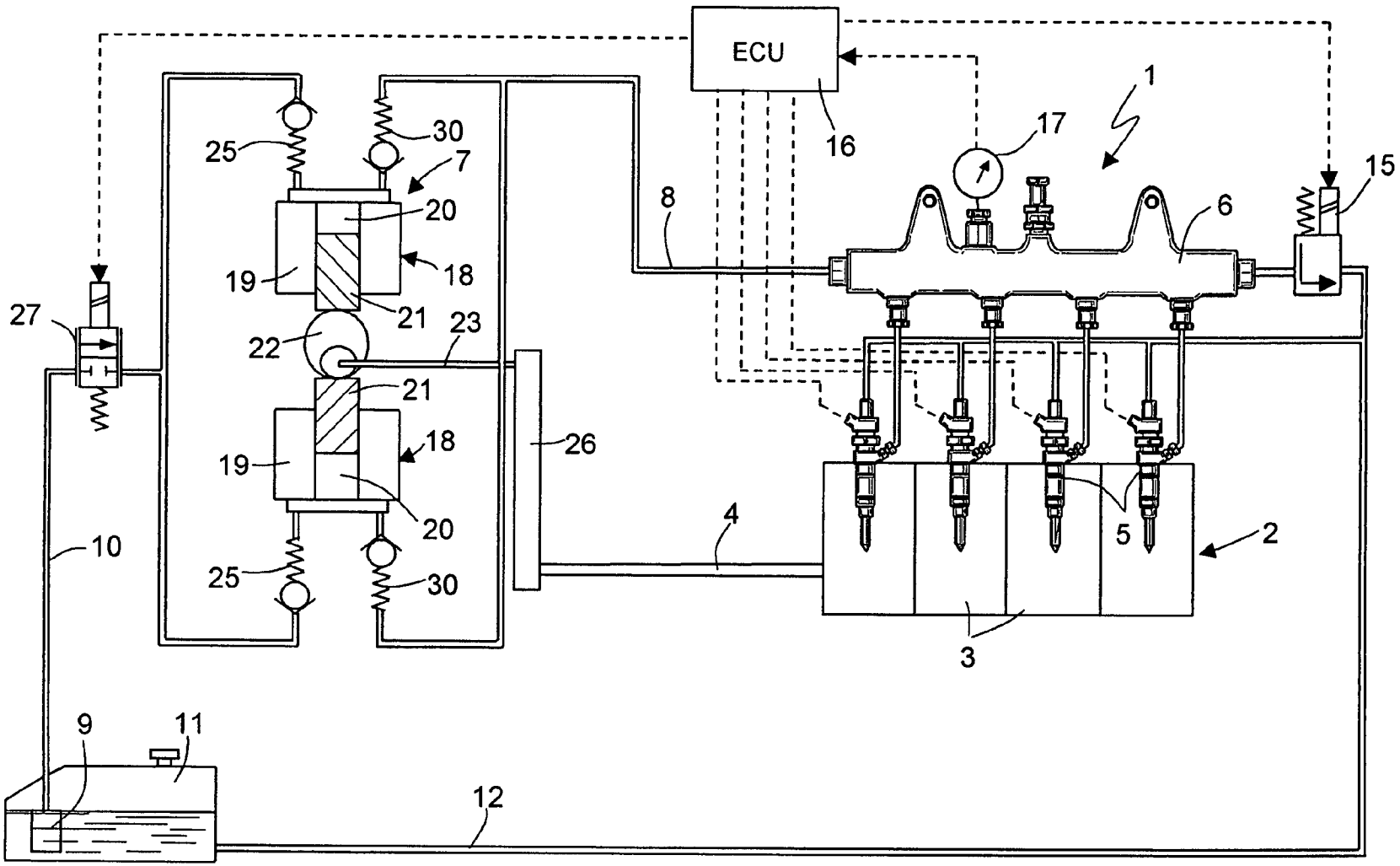

The present invention relates to a high-pressure variable-flow-rate pump for a fuel injection system of an internal combustion engine.

As is known, in modern internal combustion engines, the high-pressure pump is designed to send fuel to a common rail (the system being referred to as common-rail fuel-injection system) having a pre-set storage volume of pressurized fuel, for supplying a plurality of injectors associated to the cylinders of the engine. To obtain a proper atomization of the fuel, this must be brought to a very high pressure, in the region of 1600 bar in the conditions of maximum power of the engine. The pressure of the fuel required in the common rail is in general defined by an electronic control unit as a function of the operating conditions, i.e., the running conditions of the engine.

Injection systems are known in which a by-pass solenoid valve, arranged on the delivery pipe of the pump, is controlled by the control unit for draining directly the fuel just pumped in excess of the amount taken in by the injectors, into the usual fuel tank, before said fuel enters into the common rail.

Since the flow rate of the high-pressure pump depends in general upon the revolution speed of the engine crankshaft, it must be sized so as to achieve the maximum flow rate and pressure values required by the various operating conditions of the engine. In certain operating conditions, for example at the maximum speed but with low power supplied by the engine, the flow rate of the pump proves overabundant, and the fuel in excess is simply drained into the tank. Consequently, these known regulation devices present the drawback of dissipating part of the compression work of the high-pressure pump in the form of heat.

High-pressure variable-flow-rate pumps have been proposed to reduce the amount of fuel pumped when the engine functions at low power. In one of these pumps, the intake pipe is provided with a flow-rate regulation device comprising a restriction with a cross section that varies with continuity, which is controlled by the electronic-control unit as a function of the pressure required in the common rail and/or as a function of the operating conditions of the engine.

In particular, the restriction in the intake pipe is supplied with a constant pressure difference $\Delta P$ of approximately 5 bar, supplied by an auxiliary pump. By varying with continuity the effective area of passage there is obtained a modulation of the amount taken in by the hydraulically connected pumping elements. The amount of fuel downstream of the regulation solenoid valve, i.e., the one allowed at intake is at a very low pressure and yields, at low flow rates, only a low contribution of force for opening the intake valves. Consequently, the usual return spring of the intake valve must be such as to enable opening thereof even at a minimum pressure close to zero downstream of the restriction. On the one hand, said spring must be calibrated in a very precise way, so that the pump proves relatively costly, and, on the other hand, there is always the risk that the intake valve will be unable to open on account of the negative pressure caused by the pumping element in the corresponding compression chamber, so that the pump does not function correctly and is highly subject to deterioration. Furthermore, in any case, if the pump is provided with a number of pumping elements, it gives rise to asymmetrical delivery.

The purpose of the invention is to provide a high-pressure fuel pump with a flow-rate regulation device which is of high reliability and of contained cost and will enable the drawbacks of fuel pumps of the known art to be overcome.

According to the invention, the above purpose is achieved by a high-pressure variable-flow-rate pump for a fuel-injection system of an internal-combustion engine, comprising at least one pumping element, which is actuated in reciprocating motion through suction and delivery strokes and is provided with an intake valve in communication with an intake pipe, and a delivery valve in communication with a delivery pipe, said pump being characterized in that its flow rate is regulated by a device for regulating the fuel supplied to said pumping element, said regulation device being arranged on said intake pipe and being actuated during the suction strokes of said pumping element.

In particular, said intake valves are in communication with a common intake pipe, and the regulation device is arranged on the common intake pipe for the pumping elements and is actuated in synchronism with each suction stroke for each pumping cycle.

Figure 2:
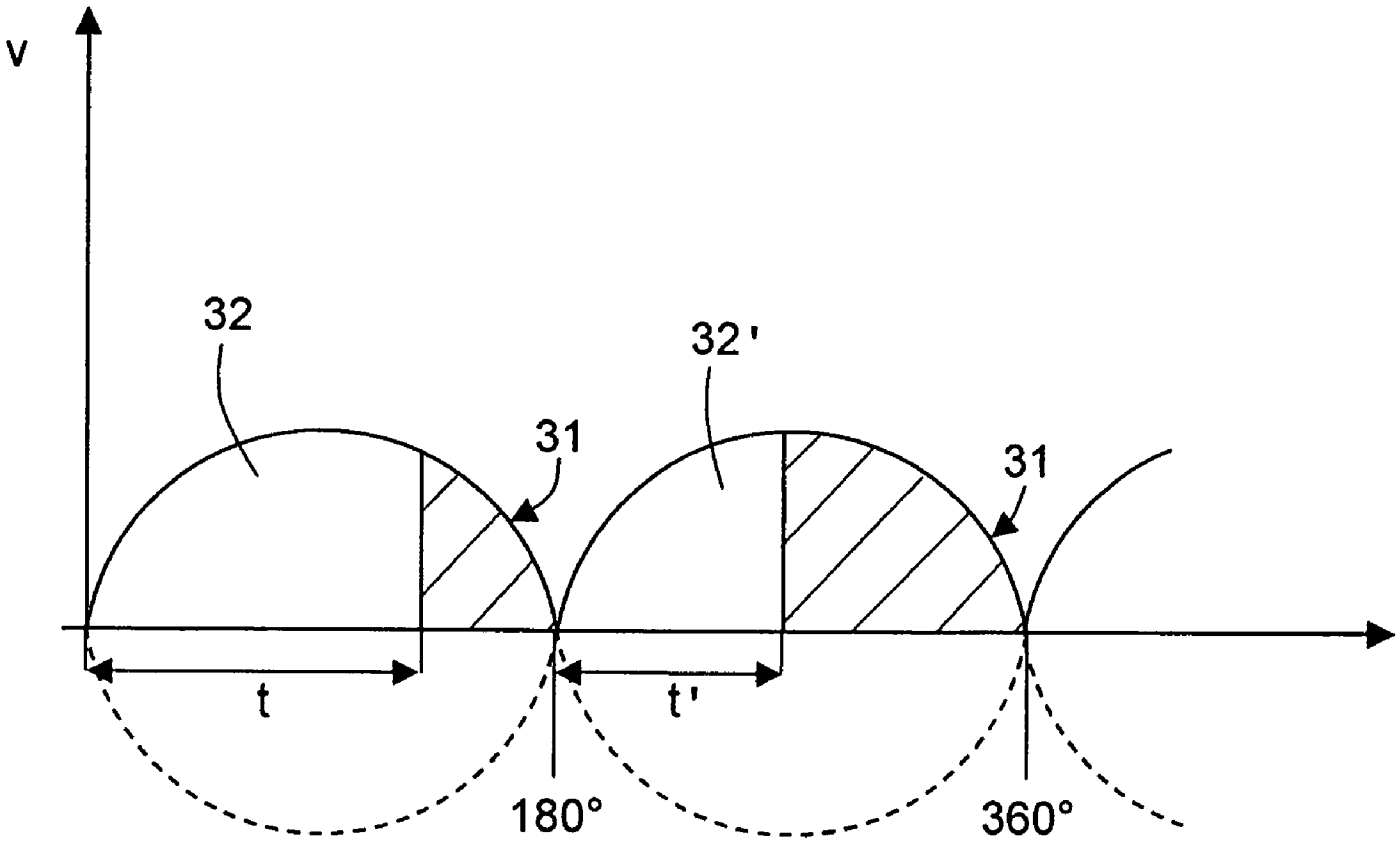

For a better understanding of the invention, there is provided a description of a preferred embodiment, by way of example and with the aid of the annexed drawings, in which:

FIG. 1 is a diagram of a fuel-injection system in an internal-combustion engine, comprising a high-pressure pump with a flow-rate regulation device according to the invention; and FIG. 2 is a diagram of the operation of the regulation device of FIG. 1.

With reference to FIG. 1, number 1 designates, as a whole, a fuel-injection system for an internal-combustion engine 2, for example, with a four-stroke diesel cycle. The engine 2 comprises a plurality of cylinders 3, for example four cylinders, which co-operate with corresponding pistons (not shown), which can be actuated for rotating an engine shaft 4.

The injection system 1 comprises a plurality of electrically controlled injectors 5, associated to the cylinders 3 and designed to inject therein the fuel at a high pressure. The injectors 5 are connected to an accumulator, which has a pre-set volume for one or more injectors 5. In the embodiment illustrated, the accumulator is formed by the usual common rail 6, connected to which are all the injectors 5.

The common rail 6 is supplied with fuel at a high pressure by a high-pressure pump, designated, as a whole, by 7, via a delivery pipe 8. In turn, the high-pressure pump 7 is supplied by a low-pressure pump, for example an electric pump 9, via an intake pipe 10 of the pump 7. The electric pump 9 is in general arranged in the usual fuel tank 11, into which there gives out an drain pipe 12 for the excess fuel of the injection system 1.

The common rail 6 is moreover provided with an discharge solenoid valve 15 in communication with the drain pipe 12. Each injector 5 is designed to inject, into the corresponding cylinder 3, an amount of fuel that varies between a minimum value and a maximum value, under the control of an electronic control unit 16, which can consist of the usual microprocessor control unit of the engine 2.

The control unit 16 is designed to receive signals indicating the operating conditions of the engine 2, such as the position of the accelerator pedal and the r.p.m. of the engine shaft 4, which are generated by corresponding sensors (not shown), as well as the pressure of the fuel in the common rail 6, detected by a pressure sensor 17. By processing said signals received by means of an appropriate program, the control unit 16 controls the instant and duration of actuation of the individual injectors 5. Furthermore, the control unit 16 controls opening and closing of the draining solenoid valve 15. Consequently, the discharge pipe 12 conveys towards the tank 11 both the drained fuel of the injectors 5 and the possible excess fuel in the common rail 6, drained by the solenoid valve 15.

The high-pressure pump 7 comprises a pair of pumping elements 18, each formed by a cylinder 19 having a compression chamber 20, in which there slides a piston 21, which has a reciprocating motion, consisting of a suction stroke and a delivery stroke. Each compression chamber 20 is provided with a corresponding intake valve 25 and a corresponding delivery valve 30. The valves 25 and 30 can be of the ball type and can be provided with respective return springs. The two intake valves 25 are in communication with the intake pipe 10 common to both of them, whilst the two delivery valves 30 are in communication with the delivery pipe 8 common to them.

In particular, the piston 21 is actuated by a cam 22 carried by a shaft 23 for actuation of the pump 7. In the embodiment described herein, the two pumping elements 18 are coaxial and opposite to one another, and are actuated by an single cam 22. The shaft 23 is connected to the engine shaft 4, via a motion-transmission device 26, such that the cam 22 controls a compression stroke of a piston 21 for each injection by the injectors 5 into the respective cylinders 3 of the engine 2.

In the tank 11, the fuel is at atmospheric pressure. In use, the electric pump 9 compresses the fuel to a low pressure, for example in the region of just 2–3 bar. In turn, the high-pressure pump 7 compresses the fuel received from the intake pipe 10 so as to send the fuel at a high pressure, for example in the region of 1600 bar, to the common rail 6, via the delivery pipe 8.

According to the invention, the flow rate of the pump 7 is controlled exclusively by a regulation device arranged on the intake pipe 10. The regulation device is designed to be actuated at each pumping cycle and in synchronism with the suction strokes of the two pumping elements 18. In particular, said device comprises a shut-off solenoid valve 27, of the on-off type, having a relatively wide cross section of effective passage to enable sufficient supply of each pumping element 18 during only a portion of the corresponding suction stroke, without causing, in said portion, any drop in pressure.

In the diagram of FIG. 2, each sinusoidal curve 31 indicates the speed of a corresponding piston 21 as a function of the angle of rotation of the shaft 23. Each curve 31 comprises a half-wave indicated by a solid line, corresponding to the suction stroke of the corresponding piston 21, and a half-wave indicated by a dashed line, corresponding to the compression stroke or delivery stroke of the corresponding piston 21.

The solenoid valve 27 is designed to be controlled in a choppered way by the control unit 16, as a function of the pressure of the fuel in the manifold 6, and/or of the operating conditions of the engine 2. In particular, the control unit 16 enables opening of the solenoid valve 27 during the initial part of the suction stroke 31, and modulates with continuity closing of the solenoid valve 27 itself for controlling the effective duration t, t' of the suction phase or part 32, 32' of said stroke 31.

The on-off operation of the solenoid valve 27 enables, upstream of each compression chamber 20, a pressure to be obtained that is equal to the head of the low-pressure electric pump 9, so that the conditions of opening of the intake valves 25 are radically facilitated with respect to the known art. Since the two pumping elements 18 are actuated in phase opposition, the fuel sent to the pump 7, through the intake pipe 10, is taken in only by the pumping element 18 which in that instant is executing the suction stroke, whilst the intake valve 25 of the other pumping element 18 is certainly closed, since it is in the compression stroke.

From the above description, the advantages of the device for regulating the flow rate of fuel from the high-pressure pump 7 according to the invention as compared to the known art are evident. In particular, at each injection, the pressure of the fuel in the accumulator 6 can be restored rapidly. Furthermore, the return spring of each intake valve 25 does not require costly operations of high-precision calibration. Finally, the need for a by-pass solenoid valve for the fuel pumped in excess by the pump 7 is eliminated.

It is understood that various modifications and improvements can be made to the high-pressure pump and to the corresponding regulation device described above, without departing from the sphere of protection defined in the annexed claims. For example, it is possible to eliminate the motion-transmission device 26 and actuate the shaft 23 of the high-pressure pump 7 at a rate independent of the speed of the engine shaft 4. Also the solenoid valve 15 for draining the fuel from the accumulator 6 can be eliminated.

Furthermore, the two pumping elements 18 can be arranged in parallel and actuated in phase opposition by two different cams. Finally, the pump 7 can have a different number of pumping elements, for example three pumping elements actuated by a common cam with a phase offset of 120°.

The invention claimed is:

1. A high pressure variable flow-rate pump for a fuel injection system of an internal-combustion engine, comprising at least one pumping element (18), which is actuated in reciprocating motion through suction and delivery strokes, said pumping element (18) being provided with an intake valve (25) in communication with an intake pipe (10), and with a delivery valve (30) in communication with a delivery pipe (8), said variable flow rate of said pump being regulated by a switched on/off solenoid valve (27), arranged on said intake pipe (10) and controlled by a control unit (16) in synchronism with said suction stroke; characterized in that said solenoid valve (27) is provided with a relatively wide cross section to enable it to supply the pumping element (18) during a variable part (32, 32') of said suction stroke, said control unit (16) controlling said solenoid valve (27) as to be open at the beginning of said suction stroke and modulating with continuity its closing during said suction stroke.

2. The high-pressure pump according to claim 1, comprising a pair of pumping elements (18) actuated in phase opposition, the intake valve (25) of each of said pumping element (18) being in communication with a common intake pipe (10), characterized in that said solenoid valve (27) is located in said common intake pipe (10) and is actuated in synchronism with each suction stroke per pumping cycle of pumping elements (18).

3. The high-pressure pump according to claim 1, wherein said delivery pipe (8) is in communication with a common rail (6) for the fuel under pressure, characterized in that said control unit (16) controls said solenoid valve (27) as to modulate its closing during said suction stroke as a function of the pressure of the fuel in said common rail (6) and/or as a function of the operating conditions of said engine (2).

4. The high-pressure pump according to claim 2, wherein said delivery pipe (8) is in communication with a common rail (6) for the fuel under pressure, characterized in that said control unit (16) controls said solenoid valve (27) as to modulate its closing during said suction stroke as a function of the pressure of the fuel in said common rail (6) and/or as a function of the operating conditions of said engine (2).

5. In a high pressure pump of a fuel injection system having a variable flow rate for an internal-combustion engine, the pump comprising at least one pumping element (18) actuated in reciprocating motion through suction and delivery strokes and having an intake valve (25) for communication with an intake pipe (10) and a delivery valve (30) for communication with a delivery pipe (8), said flow rate of said pump being varied by an on/off solenoid valve (27) on said intake pipe (10) and controlled by a control unit (16) in synchronism with said suction stroke, the improvements wherein:

said solenoid valve (27) is provided with a cross section wide enough to enable supply of said pumping element (18) during only a portion (32, 32') of said suction stroke, said control unit (16) controlling said solenoid valve (27) to be open at a beginning of said suction stroke and closed during said suction stroke.

* * * * *